United States Patent [19]

Buettner et al.

[11] Patent Number: 4,804,602

[45] Date of Patent: Feb. 14, 1989

[54] METHOD AND APPARATUS UTILIZING CORONA ERASE FOR IMPROVING A MULTI-COLOR ELECTROPHOTOGRAPHIC IMAGE

[75] Inventors: Albert V. Buettner, Rochester; Carl E. Cowan, Pittsford, both of N.Y.

[73] Assignee: Eastman Kodak Company, Rochester, N.Y.

[21] Appl. No.: 36,200

[22] Filed: Apr. 8, 1987

Related U.S. Application Data

[63] Continuation of Ser. No. 839,009, Mar. 12, 1986, abandoned.

[51] Int. Cl.[4] ..... G03G 13/01; G03G 13/22; G03G 15/01; G03G 15/22

[52] U.S. Cl. ..... 430/42; 430/97; 430/902; 355/3 CH; 355/4

[58] Field of Search ..... 430/42, 97, 902; 355/3 R, 3 CH, 4

[56] References Cited

U.S. PATENT DOCUMENTS 3,687,661 8/1972 Sato et al. ..... 96/1.2

4,634,259 1/1987 Oishi et al. ..... 355/3 CH X

FOREIGN PATENT DOCUMENTS 2073750 10/1971 France .

1328287 8/1973 United Kingdom .

*Primary Examiner*—Roland E. Martin

*Attorney, Agent, or Firm*—Robert L. Randall

[57] ABSTRACT

An improvement in the method and apparatus for producing a multi-color electrophotographic image wherein an electrophotographic medium can be used for multiple charge-expose cycles without the accumulation of trapped charges which can result in an increase in toe voltage. The invention provides for the charging, exposing and toning of the medium to produce a first color visible image. The carrier is then returned to the first position to repeat the foregoing steps to charge, expose and tone to produce a second color visible image. Prior to the second charging step the medium is reverse charged and trapped charges are neutralized to substantially revitalize the medium to a condition closely resemblng its unused condition to substantially eliminate the rise in toe voltage.

24 Claims, 1 Drawing Sheet

METHOD AND APPARATUS UTILIZING CORONA ERASE FOR IMPROVING A MULTI-COLOR ELECTROPHOTOGRAPHIC IMAGE

This is a continuation of application Ser. No. 839,009, filed Mar. 12, 1986, now abandoned.

BACKGROUND OF THE INVENTION

This invention relates to electrographic development and more particularly to an improved method of plural stage development. While the following disclosure refers to a preferred embodiment employing liquid development, it will be understood that the invention is equally applicable to systems using dry developers.

In the liquid development of electrostatic charge latent images, as in electrophotography and in other processes that form and develop electrostatic charge patterns, a substrate having a charge pattern on its surface is contacted with a liquid developer which is essentially a suspension of colloidal toner particles in an insulating liquid. Liquid developers normally contain also a stabilizer or charge control agent. Liquid developers can be used in single stage or plural stage development processes. Examples of the latter may include the sequential development on a photoconductor of two or more color-separation images, the annotation of a previously developed image, or the repeated re-exposure and developemnt of images on a reusable photoconductor, with transfer of images after each development.

Some plural stage development processes which use liquid developers have been found to be especially significant for the electrophotographic reproduction of multi-color images of graphic arts quality. In these processes electrostatic latent images are formed sequentially on a chargeable substrate such as an electrophotographic medium or photoconductor, with liquid development or toning of each latent image before the next is formed. An example of this kind of process involves exposing an electrophotographic medium sequentially through a series of four registered color-separation transparencies wtih four sequential development or toning stages.

Heretofore it was thought that the use of a low optical density p-type photoconductor was impractical for the formation of such high quality multi-stage or multicolor images. This was because such photoconductors generate mobile "holes" and trapped electrons within the thickness of the photoconductor as compared to other types of photoconductors, wherein principally mobile charges are produced. This belief resulted, at least in part, from the fact that erase methods used for such photoconductors were unable to eliminate the electrons trapped throughout the thickness or bulk of the photoconductor, or near the positive surface, because of the inability of the trapped electrons to move. That problem is exaggerated in an imaging system requiring the use of a toner-carrying, transfer-aiding overcoat which may be used to transfer the applied toners to a final receiver sheet after multi-stage or multi-color development of the photoconductor. This is particularly true when the overcoat is of a nonconductive nature.

It has been found that nonconductive overcoats are necessary when half-tone images are generated, as is required in the graphic imaging field. A conductive overcoat has been found to be unsatisfactory for generating half-tone images because the half-tone dots on a conductive surface tend to undergo image spread and will effectively disappear under adverse humidity conditions. Even continuous tone images have been found to severely degrade under such conditions using conductive overcoats.

Thus, the use of a nonconductive overcoat with a p-type photoconductor for multi-stage imaging has exacerbated the problem of trapped charges within the thickness of the photoconductor. The build-up of trapped charges within the photoconductor under such conditions exhibits itself as a residual charge that builds with each successive charge and expose cycle. The net effect is an ever increasing electrical toe voltage (toe rise) in the photoconductor. That is, the film voltage that is achieved as a result of large exposures increases with accumulated charge-expose cycles. This is illustrated in FIG. 1, wherein the effect of large exposure versus voltage is illustrated for four successive charge-expose cycles. It will be seen that in the initial charge-expose cycle, the voltage achieved with high exposures is the lowest value, whereas with each successive charge-expose cycle, the same amount of exposure results in ever increasing final voltages. As a result, in order to maintain a usable voltage range over which the photoconductive film can operate, the initial charging voltage must be increased with each cycle. It has been found that cumulative increases in the film toe voltage of as much as 100 volts or more can occur, which results in the need to increase the initial charging voltage by an equivalent amount. Not only does this complicate the control of the charging apparatus, but it can quickly exceed the equipment and film capabilities so that the process can no longer provide the desired voltage differential. Moreover, it has been found that the toe rise is unpredictably variable so that it is difficult, if not impossible, to control the entire process to provide satisfactory film performance. If provisions are not made to maintain the useable voltage range in systems utilizing a photoconductor having the foregoing phenomena of toe voltage rise with successive charge-expose cycles, the resulting images will have an undesirable susceptibility to image variation with variations in work place humidity. A variation in image quality across the area of the image can also occur under such operating conditions. More importantly, it has been found that with increases in the toe voltage noted above, it is impossible to achieve high image density with succeeding stages or colors. All of these factors are detrimental to obtaining graphic arts quality images.

The elctrophotographic method in which the present invention operates generally comprises uniformly charging a photoconductive element, exposing the photoconductive element to a pattern of actinic radiation to form a latent electrostatic image, developing the latent image with, for example, a liquid developer composition comprising a carrier liquid, a toner and charge control agent, rinsing the developed surface of the photoconductive element with a rinse solution, and drying the image. Thereafter, the surface of the photoconductive element is recharged and exposed to a pattern of actinic radiation to form a second latent electrostatic image which is developed with a liquid developer.

The method of the present invention is useful in any electrostatic imaging process wherein a charge pattern is formed and developed with a developer on a surface which has previously been developed. It is particularly useful, however, in combination with a recently developed electrophotographic method of making lithographic color proofs. This new method and a photoconductor for use therein is described in the copending U.S. patent application of Ng et al., Ser. No. 773,528 filed Sept. 6, 1985, now U.S. Pat. No. 4,600,669. In this method a photoconductor which has a uniformly charged thin transparent dielectric overcoat is subjected to a series of exposures through registered color separation transparencies. After each exposure the dielectric layer is developed with a liquid developer, the surface is again uniformly charged and exposed. The sequence is repeated for each of the color transparencies, usually four, with all of the developed images being superposed to form a multi-color image on the overcoat.

SUMMARY OF THE INVENTION

Accordingly, the present invention provides a method and apparatus for producing a multi-color electrophotographic image that enhances the final image by the reduction or elimination of toe rise with successive charge-expose cycles of the photoconductor. Although the improvement provided by the present invention is simple and relatively easy to implement at a nominal cost, it does not have any significant negative effects on the resulting image.

According to one aspect of the present invention a method and apparatus is provided for producing a multi-stage electrophotographic image wherein the medium is charged to a first voltage $v_o$, is exposed to discharge the exposed portion of the medium to a second voltage $v_w$, and is then toned to produce a first visible image. Before the medium is again charged, exposed and toned to produce a second visible image, the medium is reverse charged with a voltage having a polarity opposite to $(v_o-v_w)$, and trapped charges are neutralized by recombination of the trapped charges with mobile charges of a polarity opposite to that of the trapped charges, to substantially eliminate toe voltage increases with successive charge-expose cycles of the medium.

According to another aspect of the invention, the medium is reverse charged with a voltage that has an absolute value equal to or greater than $(v_o-v_w)$ and having a polarity opposite to that of $(v_o-v_w)$.

According to yet another aspect of the present invention, when the medium includes a charge barrier layer, the neutralization of trapped charges includes the step of exposing the medium to actinic radiation to facilitate the recombination of trapped and mobile charges in the medium.

Still further, in accordance with another aspect of the present invention, in a system wherein the medium may or may not contain a charge barrier layer, means is provided for exposing the medium to radiation to facilitate the recombination of trapped and mobile charges therein after reverse charging only when the medium contains a charge barrier layer.

Yet another aspect of the present invention provides means for preventing toe rise in both p-type and n-type photoconductors, with and without charge barriers and regardless of whether the tonal reproduction is positive or negative.

According to a still further aspect of the present invention, apparatus is provided for producing a multi-color electrophotographic image on a p-type electrophotographic medium having a low optical density and being provided with a generally non-conductive overcoat and a charge barrier. The apparatus includes a substantially transparent carrier platen arranged for movement over a predetermined path with means for mounting the medium and a first image-bearing transparency in register on the carrier platen at a first position. Means is provided for translating the platen, transparency and medium together over the predetermined path, past means for charging the medium to a first voltage $v_o$ at a second position. Means for exposing the medium through the transparency to a first light source is provided at a third position to discharge the exposed portion of the medium to a second voltage $v_w$. A first toning element is arranged to engage the overcoat of the medium at a fourth position for selectively toning the image-bearing charged region of the medium to produce a first color visible image. Means is provided for reverse charging the toned medium with a voltage the absolute value of which is equal to or greater than $(v_o-v_w)$ and having a polarity opposite to $(v_o-v_w)$. Trapped electrons are then neutralized by exposing the medium to radiation from a second light source to recombine trapped electrons with mobile holes. The apparatus further includes means for returning the platen, transparency and neutralized medium to the first position whereby the first transparency is replaced with a second image-bearing transparency in register with the medium and for repeating the charging and exposing steps to expose the medium to the first light source to generate a second image and to tone the second image with a second toning element to produce a second color visible image in register with said first color visible image.

Various means for practicing the invention and other features and advantages thereof will be apparent from the following detailed description of illustrative preferred embodiments of the invention, reference being made to the accompanying drawings.

DESCRIPTION OF THE PREFERRED EMBODIMENTS

Although the present invention is applicable to various electrophotographic elements, methods and apparatus, the embodiment to be described is directed to a multi-color electrophotographic image producing apparatus employing p-type electrophotographic medium of the type disclosed in the above-identified copending application, having a charge barrier layer and a releasable non-conductive overcoat on which the toners are deposited.

Figure 1:
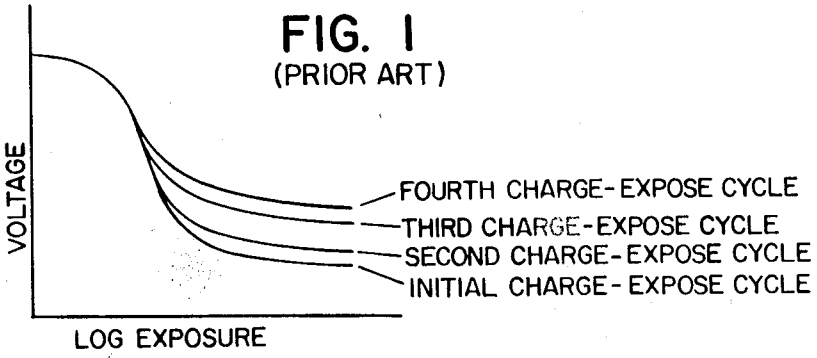
FIG. 1 (PRIOR ART)
FIG. 1 is a graphic representation of the phenomenon of toe rise with successive charge-expose cycles solved by the present invention.
Figure 2:
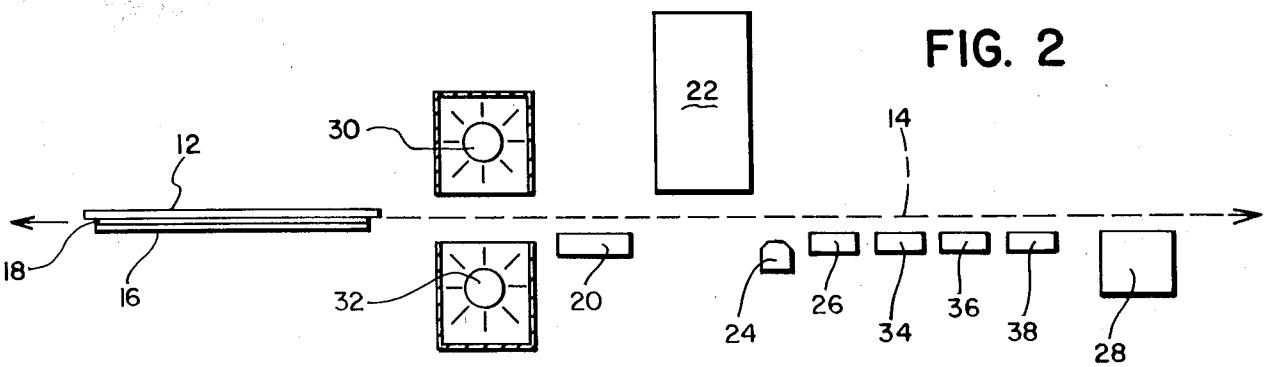
FIG. 2 is a schematic illustration of electrophotographic apparatus incorporating means for preventing toe rise.

A schematic illustration of a multi-color electrophotographic image processor is illustrated in FIG. 2 and consists of a carrier or platen 12 which is movable along the processing path, represented by dotted line 14, past the respective processing stations of the apparatus, to be described hereinafter. The path 14 may be determined by guide rails or other structure of the apparatus in a manner well-known in the art whereby the platen may move from a first position, illustrated, to the right-most position and then returned to the left to the starting position. The platen 12 is preferably transparent and is provided with means, not shown, for retaining an electrophotographic medium 16 on the lower surface thereof with an image-bearing transparency 18 disposed therebetween which is used to generate the image in the electrophotographic medium 16, in a manner more thoroughly described hereinbelow.

As noted in the above-cited copending application, the electrophotographic medium comprises a photoconductive layer on an electrically conducting substrate which is capable of transmitting actinic radiation to which the photoconductive layer is responsive. A dielectric support is releasably adhered to the substrate and either comprises the photoconductive layer or an overcoat thereof which forms an outer surface of the element capable of holding an electrostatic charge. To use the element the surface of the dielectric support is charged and the photoconductive layer is subsequently image-wise exposed to the actinic radiation, thereby forming a developable electrostatic image on the dielectric surface. The electrostatic image in turn is developed with a toner to form a first color image. A composite color image can be formed on the element by repeating the sequence one or more times with successive image-wise exposure of the photoconductive layer to actinic radiation transmitted through the transparent support and an image-bearing transparency, and developing over each preceding image with a different color toner. The composite toned image is then transferred with the dielectric support to a receiving element to form a color copy which may be a color proof closely simulating the color print expected from a color print press.

Accordingly, the electrophotographic medium 16 is mounted onto the platen 12 with the transparency original 18, which may be a color separation representing a color to be printed, sandwiched therebetween. The electrophotographic medium 16 and the transparency original 18 may be held to the platen 12 by any suitable means known in the art such as a vacuum clamp such that they are maintained in close proximity to assure satisfactory exposure, processing and registration. Further, the electrophotographic medium must also be suitably grounded to the apparatus to enable the charging process to be satisfactorily carried out. A number of grounding means are known in the art and will not be described herein. As the platen 12, with the transparency and the electrophotographic medium 16 thereon, is translated to the right (in FIG. 2), the dielectric support of the electrophotographic medium is given an overall charge via a charging means 20, such as a corona charger, to form a uniform potential, $v_o$, on the surface of the dielectric support. Upon being so charged, the electrophotographic medium is image-wise exposed by passing beneath an exposure lamp apparatus 22 which projects light through the transparent platen 12, the transparency original 18, and through the transparent conductive substrate of the electrophotographic medium. When the photoconductive layer is thus image-wise exposed, mobile charge carriers, in this case positively charged holes, are formed in the photoconductive layer and migrate away from the conducting layer as described in the above-identified application (or toward the conducting layer to give a negative image). Accordingly, the surface potential in the fully exposed regions is diminished to a potential, $v_w$, while the surface potential in unexposed regions remains approximately the same, $v_o$. As a result, an electrostatic differential pattern is formed on the dielectric support corresponding to the pattern on the transparency original.

The platen continues its movement, to the right in FIG. 2, passing over a pre-rinse head 24 which is fixed in position whereby the fluid head provided thereat, when activated, contacts the lower surface of the electrophotographic medium as it passes in the processing direction, i.e., to the right, but does not contact the medium when the fluid head is inactivated, as when the platen is moved to the left in FIG. 2, to the original position. The pre-rinse head prewets the medium with a dispersant dielectric liquid prior to the liquid toning step. Thereafter, the platen moves past a raised first liquid toning station 26 which is raised into operating position whereby the toner surface of the electrophotographic medium is contacted and a toner image is imparted thereto, in a manner well-known in the art. In this system, the liquid toner is deposited in the unexposed, still charged area of the electrophotographic medium thereby forming an image which is a duplicate of the image carried by the transparency 18. (It is well-known in the art that negative images can also be produced with similar electrophotographic processes wherein the charges imparted to the electrophotographic medium and the toners are appropriately adjusted to give a negative image.) The platen continues movement to the right in the illustration, past appropriate rinse heads and dryers, not shown. The last station 28 at the right end of the apparatus is an erase lamp that exposes the electrophotographic medium after the toning operation to expose those parts of the photoconductor layer that were not exposed by the original image exposure so that the entire electrophotographic medium has substantially the same exposure history.

Platen 12 is then reversed and is returned to the left towards the first position illustrated in FIG. 2. As the platen reaches the charging means 20, it is activated as a corona erase apparatus in accordance with the present invention. However, the charge imparted by the corona erase mode of the charging means 20 is opposite in polarity to the charge initially given the photoconductor medium and of a magnitude substantially equal to the absolute value of $(v_o - v_w)$. It has been found that, while a potential as much as 50% less or 50% greater than the initial charge differential provides a satisfactory neutralization of trapped charges in the photoconductor medium, the preferred value is equal to or greater than the absolute value of $(v_o - v_w)$. As will be described hereinbelow, with a photoconductive medium not employing a charge barrier layer, the reverse charging is adequate alone to neutralize the trapped charges therein. But with a photoconductor medium employing a charge barrier layer, it is necessary to further treat the medium by exposing it to re-erase lamps 30 and 32 on opposite sides of the platen 12. The re-erase lamps provide a non-image blanket exposure to the photoconductor 16 and, in photoconductors employing a charge barrier, release mobile charges from the photoconductor layer to neutralize the trapped charges within the thickness or bulk of the photoconductor.

The platen, transparency and medium have then reached the first position and the first original transpraency or color separation 18 is removed and replaced by a second transparency or color separation and registered with the electrophotographic medium 16 preparatory for the next pass through the apparatus to generate the second color image. When the electrophotographic medium 16 and the next original sheet 18 are re-registered on the platen 12, the platen is again moved to the right to the charging station 20 where the electrophotographic medium is again charged and then to the exposure position 22 where light again is projected through the platen and the second color separation 18 to selectively charge the photoconductive layer in accordance with the transparency or color separation then in contact with the electrophotographic medium. Thereafter, the platen moves the electrophotographic medium to the pre-rinse station 24 and then to a second toning station 34 which is in operative position to tone the surface of the electrophotographic medium with a second color toner to produce a second color visible image overlying the first image. The platen subsequently moves past the aforementioned rinse and drying stations and again past the erase exposure station 28 before being returned to the first position at the left end of the apparatus.

Should it be desired to create a four color image, or a three color plus black image, the charging, exposing, and toning steps will be repeated for two more color separation originals with the platen and electrophotographic medium being moved into operative contact with an additional two toning stations 36 and 38, one for each of the additional colors. It will be appreciated that, as known in the art, the toning order may not necessarily be represented by the physical order of the toning stations in the apparatus, and the order given above is by way of example only. Further, it should be noted that the corona erase cycle will be used after each exposure which is to be followed by a toning cycle after the corona erase. Thus, corona erase will not be necessary after the final charge-expose-tone cycle, but will be after an initial charge and expose only calibration cycle.

It has been found that toe rise, or an increase in the final voltage obtainable with extended exposures, after multiple charge-expose cycles results from a build-up of trapped charges, within the thickness or the bulk of the photoconductor or near the surface thereof having a potential opposite to that of the trapped charge. Thus with p-type photoconductors, the trapped charges are electrons, while with n-type photoconductors the trapped charges are "holes". The problems associated with the build-up of such trapped charges have been found to increase when a charge barrier layer is also incorporated. Previously, it was thought that such trapped charges could not be eliminated throughout the thickness of the photoconductor by ordinary charge or erase means. However, it has been found that with the method of the present invention it is possible to generate mobile charges in the photoconductor layer, so that the trapped charges may be recombined within the bulk or thickness of the photoconductor layer with the mobile charges. The new trapped charges photogenerated very near the surface or interface of the photoconductor layer are essentially innocuous. It is believed that the trapped charges are neutralized by the bimolecular recombination of the trapped charges with mobile charges.

It has been found that in photoconductor systems wherein no charge barrier layers are employed that the mobile charges can be spontaneously injected into the photoconductor from the conductive layer upon the application of the reverse voltage charge substantially eliminating the trapped charges. With photoconductor systems employing a charge barrier layer, the mobile charges are photogenerated by the re-erase lamp exposure following the reverse charging of the photoconductor.

Accordingly, the present invention provides a method and apparatus for regenerating a photoconductor to substantially revitalize the medium to a condition closely resembling its unused condition, substantially eliminating the rise in toe voltage associated with prior systems. The method and apparatus are simply and economically achieved and produce a high quality image suitable for use in graphic arts quality reproduction.

Further, it will be understood that the re-erase lamp must be arranged to expose both sides of the medium, as in a negative/positive mode wherein the medium is exposed through a negative, with a positive being formed by the toned image. In other situations it is possible to satisfactorily employ the present invention by only exposing one side of the medium to the re-erase lamp.

While the present invention has been described with an electrophotographic system wherein the exposure is through a transparency and a transparent platen and photoconductor, it will be appreciated that it is also applicable in systems where other means are utilized to expose the medium without the requirement that all of these elements be transparent.

The invention has been described with reference to specific embodiments and variations, but it should be apparent that other modifications and variations can be made within the spirit and scope of the invention, which is defined by the following claims.

We claim:

1. In a method for producing a multi-stage electrophotographic image comprising the steps of providing an electrophotographic medium having a relatively non-conductive overcoat upon which the image is formed on a carrier platen at a first position, translating the platen and medium together over a predetermined path, charging the medium at a second position to a first voltage $v_o$, subsequently exposing the medium to a first light-borne image at a third position to discharge the exposed portion of said medium to a second voltage $v_w$, providing a first toning element arranged to engage the medium at a fourth position and selectively toning portions of the image-bearing medium to produce a first visible image, and returning the platen and medium to the first position to repeat the charging and exposing steps to expose the medium to a second light-borne image and to tone said second image with a second toning element to produce a second visible image, the improvement comprising the steps of reverse charging the medium with a voltage having a polarity opposite to $(v_o - v_w)$, and neutralizing trapped charges in the medium by recombination of the trapped charges with mobile charges of a polarity opposite to that of the trapped charges, and performing said reverse charging of the medium and said charge neutralization after said first toning and prior to the second charging to substantially neutralize said trapped charges in said medium.

2. The method according to claim 1 wherein said reverse charging voltage has an absolute value in the range of about $\pm 50\%$ of $(v_o - v_w)$.

3. The method according to claim 1 wherein said reverse charging voltage has an absolute value equal to or greater than $(v_o - v_w)$.

4. The method according to claim 1 wherein said reverse charging voltage has an absolute value in the range of about equal to $(v_o - v_w)$ to about 150% of $(v_o - v_w)$.

5. The method according to claim 1 including the step of erase exposing the medium after the toning step and before the reverse charging step.

6. The method according to claim 1 wherein said medium includes a charge barrier layer and said step of neutralization includes the step of exposing the medium to radiation after said reverse charging to facilitate the recombination of trapped and mobile charges in the medium.

7. The method according to claim 1 wherein the medium may or may not contain a charge barrier layer and the method includes the step of exposing said medium to radiation after said reverse charging to facilitate the recombination of trapped and mobile charges therein after said reverse charging only when said medium contains a charge barrier layer.

8. The method according to claim 1 wherein said medium is a p-type electrophotographic photoconductor and the trapped charges are electrons.

9. The method according to claim 1 wherein said electrophotographic medium is an n-type photoconductor and the trapped charges are "holes".

10. The method according to claim 6 wherein said platen also carries a negative image source which is used for exposing said medium and the toning element is arranged to selectively tone the more exposed portion of the medium and wherein said radiation exposing step of said neutralization step exposes both sides of the medium.

11. The method according to claim 1 wherein said toning element is provided with a liquid toner.

12. A method for producing a multi-color electrophotographic image comprising the steps of providing a p-type electrophotographic medium and a first image-bearing transparency in register on a substantially transparent carrier platen at a first position, said medium having a low optical density and being provided with a generally non-conductive overcoat upon which the image is formed and a charge barrier, translating the platen, transparency and medium together over a predetermined path, charging the medium at a second position to a first voltage $v_o$, exposing the medium through said transparency to a first light source at a third position to discharge the exposed portion of said medium to a second voltage $v_w$, providing a first toning element arranged to engage the overcoat of the medium at a fourth position and selectively toning the image-bearing charged region of the medium to produce a first color visible image, reverse charging the medium with a voltage the absolute value of which is equal to or greater than $(v_o - v_w)$ and having a polarity opposite to $(v_o - v_w)$, then neutralizing trapped electrons by exposing the medium to radiation from a second light source to recombine trapped electrons with mobile holes, and returning the platen, transparency and medium to the first position to replace said first transparency with a second image-bearing transparency in register therewith and to repeat the charging and exposing steps to expose the medium to said first light source to generate a second image and to tone said second image with a second toning element to produce a second color visible image in register with said first color visible image.

13. In an apparatus for producing a multi-stage electrophotographic image on an electrophotographic medium having a relatively non-conductive overcoat upon which the image is formed including means for mounting the electrophotographic medium on a carrier at a first position, means for exposing the medium to light, means for translating the medium over a predetermined path, means for charging the medium at a second position to a first voltage $v_o$, means for subsequently exposing the medium to a first light-borne image at a third position to discharge the exposed portion of said medium to a second voltage $v_w$, means for providing a first toning element arranged to engage toning portions of the image-bearing medium to produce a first visible image, and means for returning the medium to the first position to repeat the charging and exposing steps to expose the medium to a second light-borne image and to tone said second image with a second toning element to produce a second visible image, the improvement comprising means for reverse charging the medium asynchronously with exposure of the medium to said light exposing means with a voltage having a polarity opposite to $(v_o - v_w)$, and means for actuating said reverse charging means after the production of said first visible image and before the second charging whereby trapped charges in the medium are neutralized by recombination of the trapped charges with mobile charges of a polarity opposite to that of the trapped charges.

14. The invention according to claim 13 wherein said reverse charging means is arranged to provide a voltage with an absolute value in the range of about ±50% of $(v_o - v_w)$.

15. The invention according to claim 13 wherein said reverse charging means is arranged to provide a voltage with an absolute value equal to or greater than $(v_o - v_w)$.

16. The invention according to claim 13 including means for erase exposing the medium after the toning step and before the reverse charging step.

17. The invention according to claim 13 wherein said medium includes a charge barrier layer and said apparatus includes means for exposing the medium to radiation after said reverse charging means to facilitate the recombination of trapped and mobile charges in the medium.

18. The invention according to claim 13 wherein the medium may or may not contain a charge barrier layer and said apparatus includes means for exposing said medium to radiation to facilitate the recombination of trapped and mobile charges therein after said reverse charging means only when said medium contains a charge barrier layer.

19. The invention according to claim 17, wherein said radiation exposing means is arranged to expose both sides of the medium.

20. The invention according to claim 13 wherein means is provided for supplying said toning means with a liquid toner.

21. Apparatus for producing a multi-color electrophotographic image on a p-type electrophotographic medium having a low optical density and being provided with a generally non-conductive overcoat and a charge barrier, said apparatus comprising a substantially transparent carrier platen arranged for movement over a predetermined path, means for mounting said medium and a first image-bearing transparency in register on said carrier platen at a first position, means for translating said platen, transparency and medium together over said predetermined path, means for charging the medium at a second position to a first voltage $v_o$, means for exposing the medium through said transparency to a first light source at a third position to discharge the exposed portion of said medium to a second voltage $v_w$, means providing a first toning element arranged to engage the overcoat of the medium at a fourth position, and means for selectively toning the image-bearing charged region of the medium to produce a first color visible image, means for reverse charging the toned medium with a voltage the absolute value of which is equal to or greater than $(v_o - v_w)$ and having a polarity opposite to $(v_o - v_w)$, and means for neutralizing trapped electrons by exposing the medium to radiation from a second light source to recombine trapped electrons with mobile holes, and means for returning the platen, transparency and neutralized medium to the first position whereby said first transparency is replaced with a second image-bearing transparency in register therewith, and means for repeatig the charging and exposing steps to expose the medium to said first light source to generate a second image and to tone said second image with a second toning element to produce a second color visible image in register with said first color visible image.

22. In the method of producing a multi-stage electrophotographic record on an electrophotographic medium having a relatively non-conducting overcoat upon which the image is formed and in which successively formed electrostatic images of predetermined polarity are sequentially developed in superposition on the medium with electroscopic toner, the improvement comprising, applying to the medium an electrostatic charge of a polarity opposite said predetermined polarity between the developing of one electrostatic image and the forming of the next image to neutralize any trapped charges to the medium prior to formation and development of the next image.

23. In an apparatus for producing a multi-stage electrophotographic record on an electrophotographic medium having a relatively non-conductive overcoat upon which the image is formed comprising means for exposing said medium to light, means for successively forming electrostatic images of predetermined polarity on the medium, and means for sequentially developing said images in superposition on the electrophotographic medium with electroscopic toner, the improvement comprising, means for applying to the medium an electrostatic charge of a polarity opposite said predetermined polarity asynchronously with the exposure of the medium to said light exposing means, and means for actuating said opposite polarity charging means after one electrostatic image has been developed and before the next image is formed whereby any trapped charges in the medium are neutralized prior to formation and development of the next image.

24. In an apparatus for producing a multi-stage electrophotographic image on an electrophotographic medium having a relatively non-conductive overcoat upon which the image is formed including means for mounting the electrophotographic medium on a carrier at a first position, means for translating the medium over a predetermined path, means for charging the medium at a second position to a first voltage $v_o$, means for subsequently exposing the medium to a first light-borne image at a third position to discharge the exposed portion of said medium to a second voltage $v_w$, means for providing a first toning element arranged to engage the medium at a fourth position for selectively toning portions of the image-bearing medium to produce a first visible image, and means for returning the medium to the first position to repeat the charging step at the second position with the same charging means and at the same polarity as the first voltage $v_o$, and means for exposing the medium to a second light-borne image at the third position, and means for toning said second image with a second toning element to produce a second visible image, the improvement comprising means for reverse charging the medium asynchronously with exposure of the medium to a light exposing means with a voltage having a polarity opposite to $(v_o - v_w)$ and having an absolute value in the range of about equal to $(v_o - v_w)$ to about 150% of $(v_o - v_w)$, and means for actuating said reverse charging means after the production of said first visible image and before the second charging whereby trapped charges in the medium are neutralized by recombination of the trapped charges with mobile charges of a polarity opposite to that of the trapped charges.

* * * * *